US005196240A

United States Patent [19]

Stockwell

[11] Patent Number: 5,196,240

[45] Date of Patent: Mar. 23, 1993

[54] SEAMLESS BODYSUIT AND A METHOD FOR FABRICATING SAME

[76] Inventor: Gregg M. Stockwell, 1513 Via Madrina St., San Diego, Calif. 92111

[21] Appl. No.: 670,579

[22] Filed: Mar. 18, 1991

[51] Int. Cl.[5] ..... B05D 3/02

[52] U.S. Cl. ..... 427/389.9; 2/82; 427/393.4; 427/421; 427/401

[58] Field of Search ..... 2/82; 427/389.9, 421, 427/401, 393.4; 428/266

[56] References Cited

U.S. PATENT DOCUMENTS

| | | | |
|---|---|---|---|
| 3,513,825 | 5/1970 | Chun | 126/204 |
| 3,731,319 | 5/1973 | O'Neill | 2/2.1 R |
| 4,194,041 | 3/1980 | Gore et al. | 428/315 |
| 4,215,171 | 7/1980 | Marco et al. | 427/389.9 X |
| 4,388,134 | 6/1983 | Long et al. | 156/248 |

*Primary Examiner*—Michael Lusignan
*Attorney, Agent, or Firm*—Brown, Martin, Haller & McClain

[57] ABSTRACT

A seamless bodysuit and the method for fabricating same, including a process for preparing a textile coating compound. The seamless, one-piece bodysuit for a person consists of a textile foundation fitted to a mannequin that is then sealed with a coating compound prepared in accordance with a novel process. The bodysuit includes sealing means at wrist, ankle, and neck openings for mating with suitable gloves, boots, and helmet or hood and can be fabricated for use as a wet suit, a dry suit, a biohazard suit, or in other similar applications. The textile coating compound is colorized and can support decorative inclusions, permitting fabrication of bodysuits having a variety of patterns in different colors that will remain undiminished for the life of the bodysuit. The coating compound is substantially inert and suitable for use in corrosive environments. The disclosed fabrication method permits variation of the bodysuit thickness at the joints to accommodate movement and to adjust thermal transfer and abrasion resistance where appropriate. The bodysuit is fabricated without seams, ensuring continued reliability of the airtight and watertight features. Other inherent features include high thermal resistance, negative buoyancy, and resistance to the effects of ultraviolet light.

22 Claims, 5 Drawing Sheets

SEAMLESS BODYSUIT AND A METHOD FOR FABRICATING SAME

BACKGROUND OF THE INVENTION

1. Field of the Invention

My invention relates generally to a process for formulating and applying a coating and sealing compound suitable for use in waterproofing textiles, and, more specifically, to a method for fabricating a seamless bodysuit for a variety of uses.

2. Description of the Related Art

A wide range of impermeable materials are known in the art suitable for use in the fabrication of special clothing intended to protect the wearer in cold, wet, or otherwise inhospitable environments. The well-known wet suit is a tightly fitting garment worn by cold-water swimmers as protection against the cold temperatures. The wet suit is so-called because it is normally flooded and performs its function by holding a layer of water against the skin of the swimmer. This layer of water is heated to body temperature by body heat and insulates the swimmer from the ambient water temperature because the wet suit prevents circulation of ambient water against the swimmer's skin.

The dry suit is also used by swimmers and divers for protection against the cold water temperature but, unlike the wet suit, is not flooded and performs by insulating the swimmer from the cold water while sealing against flooding. The dry suit generally provides auxiliary heating means and/or thicker insulation means than is necessary with the wet suit because the dry suit has no provision for holding an insulating layer of warm, static water against the swimmer's skin.

A biohazard suit is known in the art for protecting the wearer against exposure to hazardous biological material in the environment. The biohazard suit is sealed against flooding by air or water and attaches to sealed boots, helmet and gloves to completely isolate the wearer from the hazardous environment.

The general bodysuit class of protective wear includes the biohazard suit, the wet suit, the dry suit, and other similar protective wear having requirements for high thermal insulation, low permeability, precise mechanical fit on the body of the wearer, and resistance to accidental breaks and leakage. Other important requirements for this bodysuit class of protective wear is flexibility for wearer mobility, fire resistance, zero buoyancy, suitability for embedded wiring and sensors, and visibility (coloration).

The dry suit and wet suit known in the art consists of layers of neoprene foam rubber stitched together with appropriate seals or water-tight zippers to permit the wearer to don and doff the suit. The neoprene foam bodysuit has several well-known disadvantages. The neoprene foam seams are prone to leakage. The neoprene rubber is highly flammable, is prone to UV degradation, is easily breached by abrasion, and is restrictive of wearer mobility because of the thickness required for acceptable thermal insulation values. Moreover, the neoprene foam wet suit is highly buoyant, requiring inconvenient weight belts in underwater use. Similar disadvantages are known for other neoprene foam bodysuits fabricated for use as dry suits and other related applications.

Because of these well-known disadvantages, numerous improvements have been attempted by practitioners in the art over the years to overcome such disadvantages. For instance, U.S. Pat. No. 3,731,319 issued to Jack E. O'Neill on May 8, 1973, discloses a suit provided with tight inturned seals at the neck, ankles, and wrists to make them substantially watertight. The suit is made in one piece with a single zipper across the back of the shoulders, extending from arm to arm, permitting the suit to function either as a wet suit or a dry suit. O'Neill does not suggest a solution to the abrasion, seam failure, flammability, or excessive buoyancy problems, although he does teach the use of air inflation to increase buoyancy.

U.S. Pat. No. 4,464,795 issued to Richard W. Long, et al. on Aug. 14, 1984, discloses an easy-access underwater diving suit with provisions for adjustment to the height of the diver to overcome the common problem of poor fit found with neoprene foam bodysuits. U.S. Pat. No. 4,388,134 issued to Richard W. Long, et al. on Jun. 14, 1983, discloses a method of sealing a neoprene foam material seam that overcomes the worst of the well-known seam leakage problems, but Long, et al. do not suggest or disclose any methods for seamless fabrication of a bodysuit to overcome all disadvantages of such seams.

To obtain satisfactory thermal insulation using only neoprene foam rubber, most bodysuits known in the art become so thick that the mobility of the wearer is seriously impaired. Practitioners have addressed this problem in the past by improving the suit material to increase thermal insulation. For instance, U.S. Pat. No. 3,513,825 issued to F. H. Chun on May 26, 1970, discloses a protective diving suit comprising a protective laminate having a flexible foam core provided with intercommunicating cells and an elastomeric foam skin at each side of the core. Chun fills his foam core with a liquid, preferably distilled water, to enhance the thermal insulation properties of his suit. Chun also provides electrical heating means for heating the liquid in his foam core.

The well-known mechanical vulnerability of neoprene foamrubber sheets results in frequent unintentional breach of the bodysuit by abrasion and tearing. This problem has also been addressed by many practitioners in the art. For instance, U.S. Pat. No. 3,725,173 issued to C. S. Johnson, et al. on Apr. 3, 1973, discloses a method of making a protective diving suit that includes a fish scale arrangement of overlapping plastic chips sandwiched between layers of neoprene rubber to form a type of body armor.

There has also been much interest in the improvement of bodysuits intended for applications in dry hazardous environments. For instance, U.S. Pat. No. 4,194,041 issued to Robert W. Gore, et al. on Mar. 18, 1980, discloses a waterproof laminate that prevents liquid water from penetrating through from the outside but permits the evaporation of perspiration and other moisture from within the garment. The Gore, et al. invention is suitable for use in biohazard suits and related applications requiring an impermeable garment that may be worn comfortably in a dry, room-temperature environment.

Although practitioners have addressed one or more of the many deficiencies of the typical neoprene foam rubber bodysuit, a strongly-felt need exists for a novel bodysuit design that avoids all or most such difficulties. Such a bodysuit design would provide high thermal insulation without sacrificing flexibility or mobility, seamless construction to preserve impermeability to moisture and other contaminants, a custom fit for every wearer, inherent resistance to UV light degradation and high resistance to accidental breach or leakage through abrasion or tearing, variable thickness and flexibility at the joints for enhanced mobility, high fire resistance, zero or negative buoyancy, provisions for embedding wires and sensors within the insulating layers of the suit, and complete color and decorative flexibility.

This combination of unresolved problems and deficiencies is clearly felt in the art and is solved by my invention in the manner described below.

SUMMARY OF THE INVENTION

My invention is a new method for fabricating a seamless bodysuit that can be adapted to a variety of applications. An important part of my invention is a method for formulating, mixing, and applying a sealing compound to a tailored fabric or textile. My new compound is based on the silicone rubber adhesive sealant known in the art and is unrelated to neoprene rubber. My new compound is not limited to bodysuit fabrication and can be used in any application requiring the sealing of textiles and the insulation of surfaces.

The silicone rubber adhesive sealant known in the art is not suitable for coating textiles. I have invented a new method that permits the application of a silicone rubber adhesive sealant compound to textiles having weaves of up to 185 threads per inch or more whereby the textile is sealed, insulated and bonded with a tough, impermeable layer of silicone rubber. This silicone rubber layer provides 250% more thermal insulation than the same thickness of neoprene foam rubber. My coating formulation is 500% more resistant to abrasion than neoprene foam rubber and is inflammable at all temperatures below 400° F. My formulation is highly resistant to ultraviolet light damage and can be colored and decorated in many different ways. The thermal insulation properties of my formulation can be further increased with the addition of titanium dioxide powder. Coating suspensions such as Mylar® flakes, pearl essence, glitter, and the like, can be added to my coating formulation for decorating purposes.

To fabricate a bodysuit using my improved formulation, I first tailor a fabric or textile bodysuit foundation on a mannequin, which is shaped in accordance with the wearer's body. My coating formulation is then prepared and applied to the bodysuit foundation in one or more layers to seal the foundation fabric and provide thermal insulation. During the application process, the thickness of the bodysuit can be adjusted to increase flexibility at the inside joints and to increase abrasion resistance and thermal insulation at the outside joints as desired. Coloration and decorative suspensions can be changed or varied without limit during the application process to provide any desired pattern of color and decor. Sensors, wires or instruments can be embedded in the coating layer as desired prior to the curing step. Once the coating application is complete, the bodysuit is cured and removed from the mannequin. The resulting bodysuit is completely seamless and can be provided with seals at the wrists, ankles and neck, either for use as a dry suit or for attachment to gloves, boots, and helmet for use as a biohazard suit or the like.

The thermal insulation and buoyancy properties of my bodysuit invention can be varied by adding entrapped air or gas bubbles during the application process and by adding titanium dioxide to the coating preparation for coloration and thermal insulation purposes. My new coating formulation may be used for fabrication of many other items such as tent canvas, raincoats, and the like. My formulation is also suitable for anticorrosion sealing or thermal insulation of containers and other objects unrelated to fabrics and textiles.

My bodysuit can be tailored to a variety of designs including two-piece suits, abbreviated surfing suits, and special purpose overgarments as well as my preferred one-piece seamless bodysuit design. The fabrication method can accommodate most of the improvements known in the art for neoprene foam rubber wet suits and dry suits, including external heating means, liquid core sandwiches, pressure compensation devices, armor-core schemes, and so forth.

The foregoing, together with other features and advantages of the present invention, will become more apparent when referring to the following specifications, claims, and accompanying drawings.

BRIEF DESCRIPTION OF THE DRAWINGS

For a more complete understanding of my invention, I now refer to the following detailed description of the embodiments illustrated in the accompanying drawings, wherein.

DESCRIPTION OF THE PREFERRED EMBODIMENTS

Figure 1:
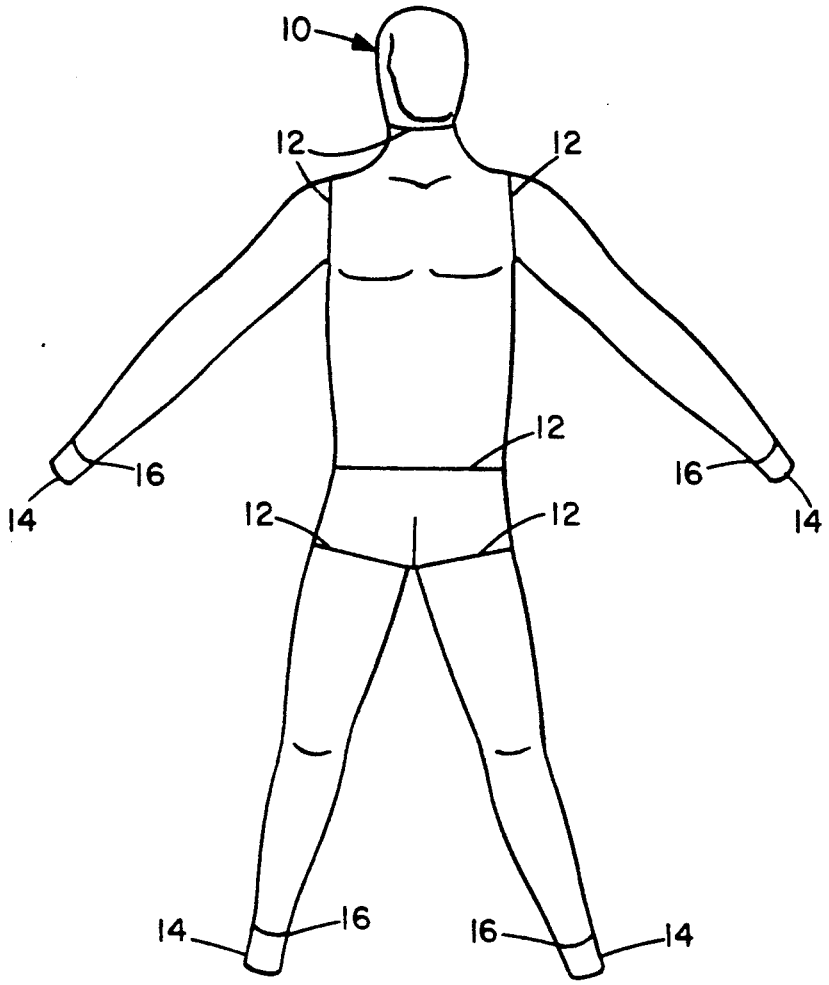
FIG. 1 is a an illustration of a segmented mannequin used as a form for a bodysuit foundation.

FIG. 1 shows a sketch of a fiberglass mannequin 10 comprising sections that are joined at the joints 12 by suitable means. Joints 12 permit the removal of head, limb, and trunk portions of mannequin 10 for any reason including replacement with sections having different sizes. The limb sections can be extended by one or more limb extensions 14 joined at the extension joints 16 in any suitable manner. Use of limb extensions 14 adds additional flexibility to the adjustability of size and proportion for mannequin 10. Mannequin 10 may comprise any suitable material but I prefer fiberglass for its ease of fabrication.

Figure 2:
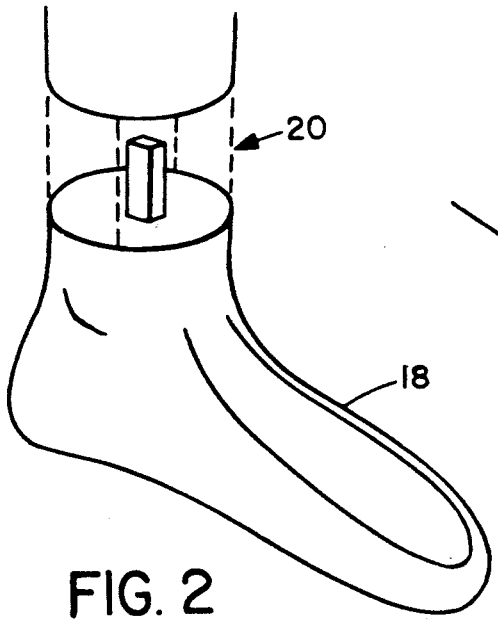
FIG. 2 is a detail showing a removable foot mold.
Figure 3:
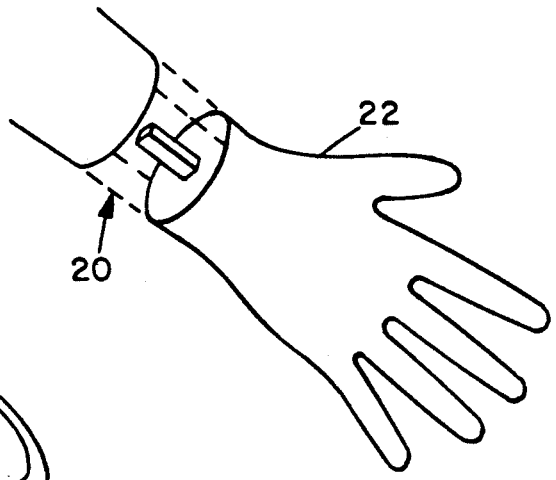
FIG. 3 is a detail showing a removable hand mold.

FIG. 2 illustrates the addition of a fiberglass foot mold 18 that is attached to mannequin 10 using a simple slip joint 20. FIG. 3 similarly shows a fiberglass hand mold 22 attached to mannequin 10 by similar slip joint 20. Foot mold 18 and hand mold 22 can be provided in a range of sizes or custom-made for individuals. With foot molds 18 and hand molds 22 in place, mannequin 10 can be used to fabricate a full bodysuit having integral, seamless glove and boot portions.

Figure 4:
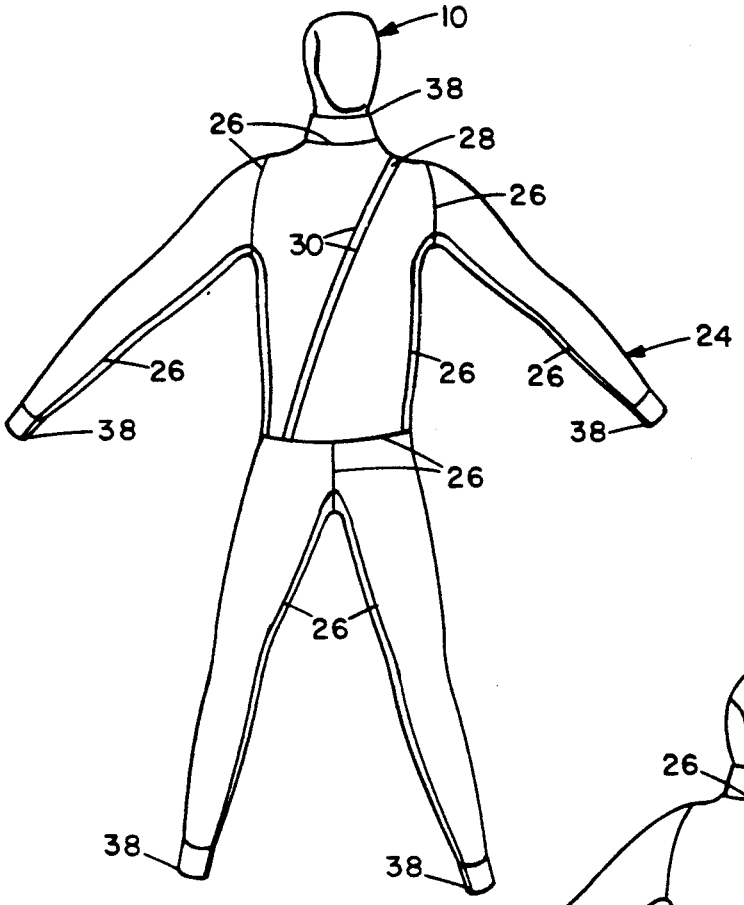
FIG. 4 is a representation of an illustrated textile bodysuit foundation tailored and positioned on the mannequin.
Figure 5:
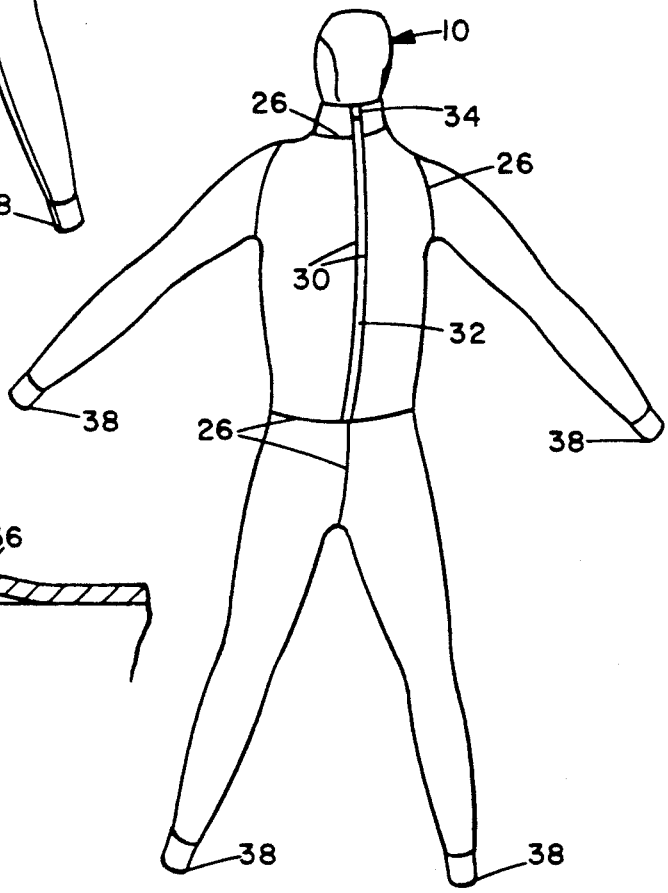
FIG. 5 is a rear view of the representation shown in FIG. 4.

My method for fabricating a seamless bodysuit requires the use of mannequin 10 to hold a bodysuit foundation during a rubber coating operation to be described. In FIG. 4, a bodysuit foundation 24 is shown mounted on mannequin 10. Foundation 24 is preferably a tightly woven textile that is sewn along the seams 26 such that foundation 24 fits snugly against mannequin 10. A zipper 28 is shown stitched into foundation 24 along the zipper seams 30. Zipper 28 is a preferred apparatus for permitting the wearer to easily don and doff the finished bodysuit. In FIG. 5, the backside of foundation 24 is shown having seams 26, zipper 32, and zipper seams 30 as discussed in connection with FIG. 4. In addition, FIG. 5 shows a fastener 34 at the high neck that may be hook and loop (e.g., Velcro ®) or the like. Zipper 32 can be a drysuit zipper, a spine pad, a hook and loop flap or the like as desired for the particular application.

Figure 6:
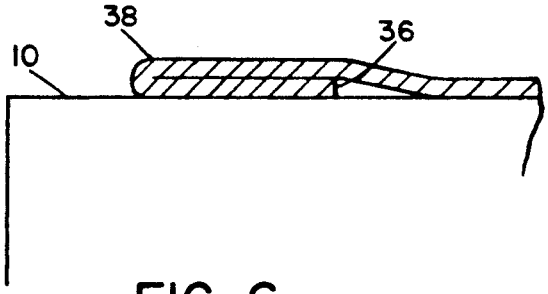
FIG. 6 is a detail showing the wrist, ankle and neck edge configurations of the bodysuit foundation.

FIG. 6 illustrates in cross section my preferred method for forming the end seams 38 at the neck, wrists and ankles. The bodysuit foundation fabric 36 is shown folded under in preparation for the rubberized coating process. The neck, wrist and ankle end seams 38 are also shown in FIGS. 4 and 5.

After mannequin 10 has been assembled in the proper dimensions and bodysuit foundation 24 has been sewn in place on mannequin 10, the rubberized coating can be applied in any suitable manner, including dipping, brushing and spraying. Before application, my coating compound must be prepared in accordance with the procedure to be described below. The coating compound should be freshly prepared immediately before application to bodysuit foundation 24. If the coating compound is placed in an airtight container, it may be prepared a couple of hours before application. Once applied, my coating compound may be cured in many ways, including heat application, forced ventilation, UV illumination and mere natural convection at room temperature.

The first step in preparing my coating compound is to add a quantity of medium naphtha to a mixing container. The medium naphtha is typically a colorless liquid with a boiling point between 216° F.–274° F., and a specific gravity of 0.8. The second step is to form a second solvent by mixing with the medium naphtha one of the group of solvents consisting of 1,1,1-trichloroethane, trichloroethylene, toluene, xylene, methyl ethyl ketone, hexane and methylene chloride. Other secondary solvents with similar characteristics can be used, but one of this preferred group is recommended. I prefer to use 1 part by volume of 1,1,1-trichloroethane and 3 parts by volume of medium naphtha to form a second solvent suitable as a base for a sprayable compound. These proportions can be adjusted in consideration of the method of application contemplated; whether by spraying, brushing, or dipping, or other.

Following preparation of the second solvent, I next mix in a coloring agent. I prefer a thermoset resin coloring agent such as Day-Glo ® T-Series and GT-Series pigments. These thermoset resin pigments have a specific gravity of 1.37, an average particle size of about 5 microns by volume, a bulking volume of about 0.0875 gallons per pound, and a decomposition temperature of about 380° F. These pigments are also insoluble in water and hydrocarbons. I also prefer to use $TiO_2$ powder as a white pigment because this compound also increases substantially the thermal resistance of the coating compound. I prefer to mix up to 2% by volume of the thermoset resin or titanium dioxide powder to the solvent, varying the proportion as necessary to obtain the desired color characteristics and intensity.

I next add an ultraviolet light inhibiting compound to the colorized solvent. I prefer Tunivin ® 292 or one of the hydroxyphenyl benzotriazole UV absorbers such as Tunivin ® 1130. Tunivin ® 292 has a specific gravity of 0.993, a boiling point of 230° C. and does not function by a UV absorption mechanism. Tunivin ® 1130 has a specific gravity of 1.17 and functions as a UV absorber with maxima at 301.6 nm and 340.3 nm. I prefer to add 0.5% to 2% by volume of the UV absorber to the colorized solvent to form a UV-inhibited colorized solvent.

My next preparation step is the most important one for proper application, adhesion and curing of the bodysuit coating. In this step, I add a thixotropic compound to the UV-inhibited colorized solvent. I prefer to use silicon dioxide formulations such as AEROSIL ® 200 as a thixotropic agent. AEROSIL ® 200 has an average primary particle size of 12 nm, a tamped density cf about 40 grams/liter, and consists almost entirely of silicon dioxide ($SiO_2$). For proper application by sprayer, there is a relatively narrow range of thixotropic agent required. I prefer to add from one to two parts by volume of the AEROSIL ® 200 agent to one part of the UV-stabilized colorized solvent to form a thickened colorized solvent.

The final step in the preparation of my coating compound is the addition of about 250 parts by volume of silicone rubber adhesive sealant compound to 100 parts by volume of the thickened colorized solvent to form a sprayable coating compound. These proportions can be adjusted where a thinner or thicker coating compound consistency is required for various application techniques. The silicone rubber adhesive sealant compound should be of the type manufactured by General Electric Corporation under the RTV designation. I prefer RTV 108 having a specific gravity of 1.05 or IS 808 having a specific gravity of 1.04. Both of these compounds are of paste-like consistency and can be obtained either as a translucent compound or with added color. These particular compounds have a cured elongation rating of 450%, which I prefer for this application. The thermal conductivity of the cured silicone rubber is a low 0.0005 cal/sec/cm$^2$, °C./cm, which is an important advantage of using this compound as a bodysuit coating.

The above ingredients should be mixed in the specified sequence over a period of two minutes or less and should be agitated continuously, or stirred intermittently in an airtight container, to prevent settling and layering. If exposed to air, this coating compound will set up and cure after about two hours at room temperature and pressure. The set and cure time can be extended somewhat by using an airtight sprayer container and stirring intermittently.

Additional decorative suspensions can be added to the completed coating mixture. These include Mylar® flake, pearl essence, glitter, and the like. These decorative suspensions should be limited to small particle sizes to avoid compromising the strength and integrity of the cured bodysuit coating.

The exact proportions of the solvent and silicone rubber adhesive sealant as well as the thixotropic agent will also depend on the selection of fabric used to make up the suit foundation 24. A thinner coating compound can be formulated for tightly woven fabrics of 185 threads per inch or greater, and a thicker application can be used for solid surfaces as well as looser fabric weaves. The compound viscosity must be sufficient to permit proper application by sprayer and yet not so much as to prevent proper wetting of the tightly woven fibers in bodysuit foundation 24. Exact mixture ratios will also differ when airtight storage is employed. I prefer the 2.5 to 1 ratio disclosed above to give a thinner coating compound suitable for application by sprayer to a nylon/lycra or spandex stretch fabric with a tight weave in the manner illustrated in FIG. 7.

Figure 7:
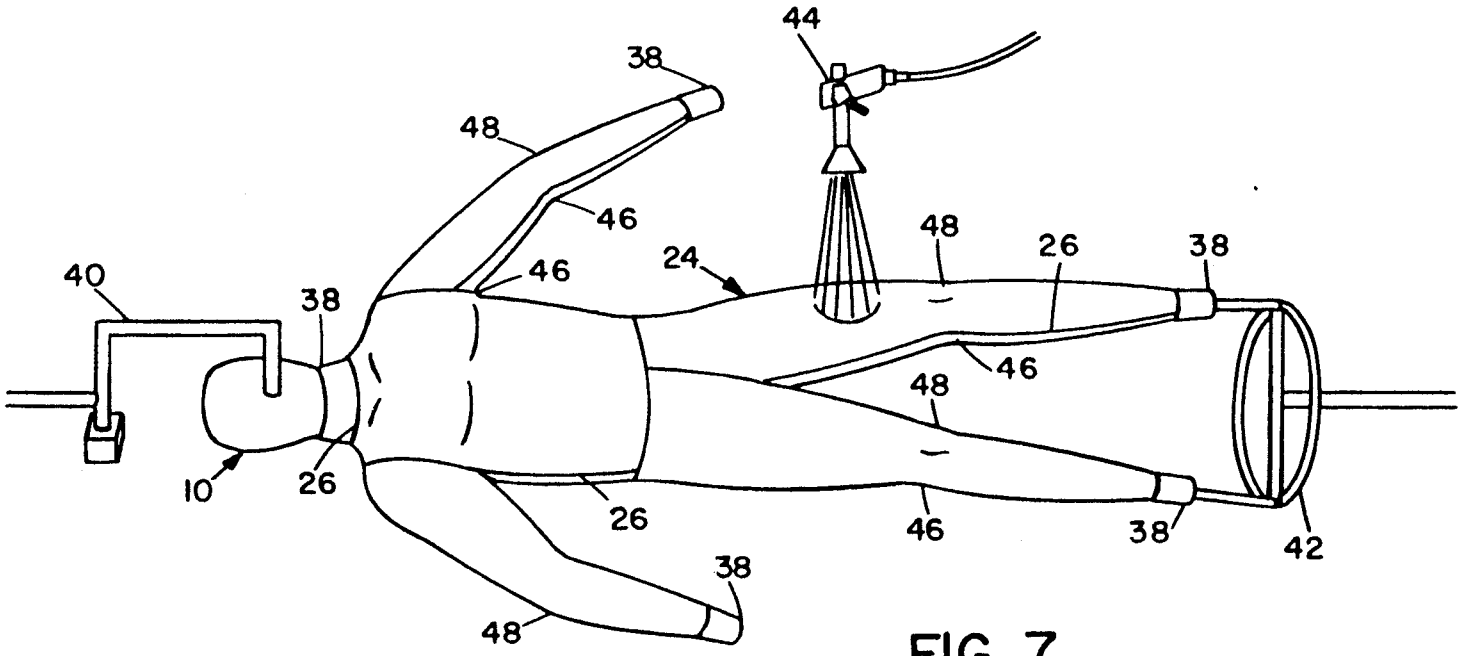
FIG. 7 is an illustration of the application of my sealing compound to the illustrated bodysuit foundation by spraying.

FIG. 7 shows mannequin 10 covered with bodysuit foundation 24 made up of a stretch fabric such as spandex or lycra. Two metal supports, 40 and 42 are shown supporting mannequin 10 in the horizontal position Supports 40 and 42 are configured to permit horizontal rotation of mannequin 10 during the spraying operation. The spray nozzle 44 can be either manual or automated and is connected to a spray tank containing a recently prepared supply of the coating compound discussed above. I have used a Graco Ultra 1000 airless sprayer with some modifications and also have successfully used a Paasche' Air Gun No. 62 to apply my coating compound to bodysuit foundation 24 in the manner shown in FIG. 7.

Figure 8:
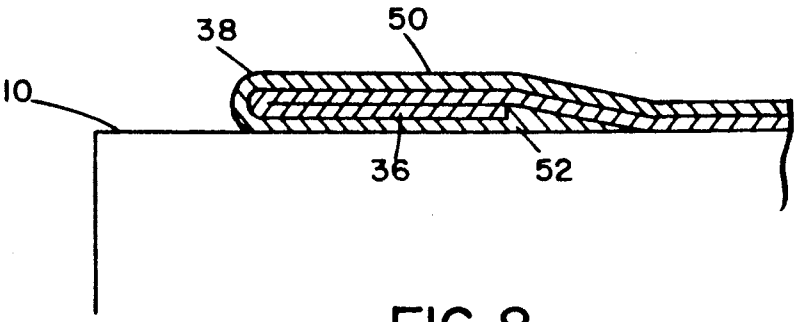
FIG. 8 is a detail showing the coated configuration of the neck, ankle and wrist edge of the bodysuit.
Figure 10:
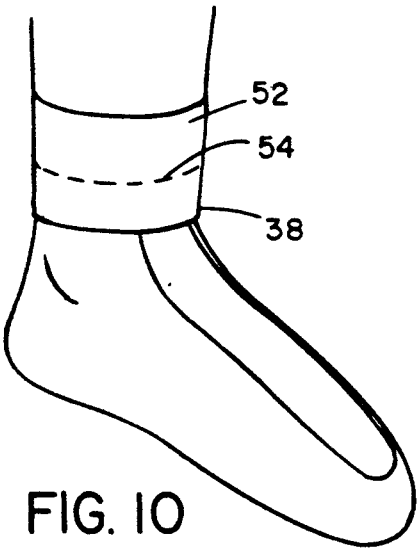
FIG. 10 is a detail showing the ankle edge coating underside of an inverted bodysuit foundation.

An important feature of my bodysuit foundation coating method is the capability for varying the coating thickness at various points on bodysuit foundation 24. For instance, the inside knee and elbow joints 46 can be provided with a thinner layer of coating compound and the outside knee and elbow joints 48 can be provided with a thicker coating by means of additional layers or a more direct and steady application. During the application process, all bodysuit foundation seams 26 are sealed over with a continuous layer of silicone rubber, resulting in a completely uniform and seamless surface. Areas which should not be covered, such as embedded compasses, indicators, clocks, and the like, can be masked to prevent coverage. Wrist, ankle and neck edges 38 can be turned under for the spraying process, as discussed above. In FIG. 8, edge 38 is shown after a rubberized coating layer has been applied during the outside spraying process and an inside rubber coating layer 52 has been later applied in the manner discussed below in connection with FIGS. 9–11.

If additional insulation is necessary, air or gas bubbles may be injected in the coating compound during the application process by means of a spraying mechanism adapted to injection of air or gas into the spray stream, or by other suitable chemical or heating means known in the art. The presence of microscopic air or gas bubbles entrapped in the silicone rubber coating layer will enhance the thermal and acoustic insulation properties of the layer but may tend to weaken the inherent mechanical strength and is not preferred for the bodysuit application As should be obvious to those skilled in the art, the coating compound prepared in accordance with my above-described method can be used for any related coating purposes and is not limited to the fabrication of bodysuits in the manner disclosed herein. For instance, my coating compound can be used in the manufacture of tent fabrics, rain coat fabrics, coated storage drums, and in all other applications requiring a variable thickness layer of thermally and acoustically insulated silicone rubber.

Figure 9:
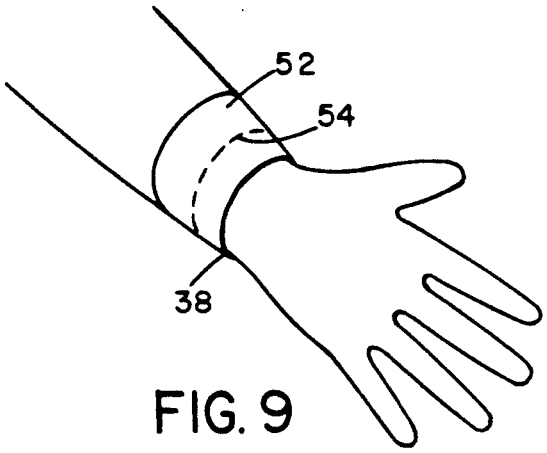
FIG. 9 is a detail showing the wrist edge coating underside of an inverted bodysuit foundation.
Figure 11:
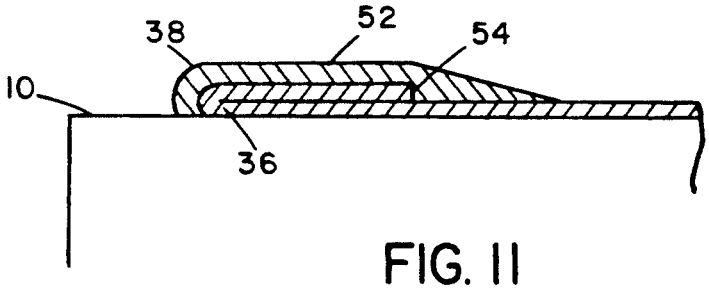
FIG. 11 is a detail showing the inverted configuration of the neck, wrist, and ankle edge of an inverted bodysuit foundation.

In FIG. 9, the coated bodysuit foundation discussed in connection with FIG. 8 is shown turned inside out and mounted on mannequin 10. Referring to FIG. 11, foundation material 36 is shown turned inside out and folded at edge 38 with the fabric end 54 exposed. Fabric end 54 is shown as a dotted line in FIGS. 9 and 10. The completion of the fabrication of the wrist and ankle seal is accomplished by applying a layer 52 of coating compound to edges 38 in FIGS. 9 and 10. Layers 52 completely cover ends 54 and provide inside rubber seals at wrist, ankle and neck as discussed above in connection with FIG. 8.

Figure 12:
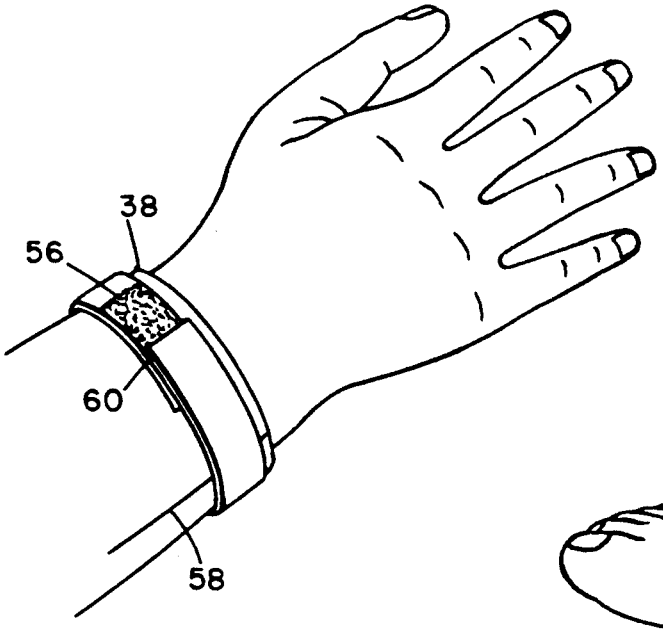
FIG. 12 shows an alternative illustrated method for sealing the wrist of the bodysuit.
Figure 13:
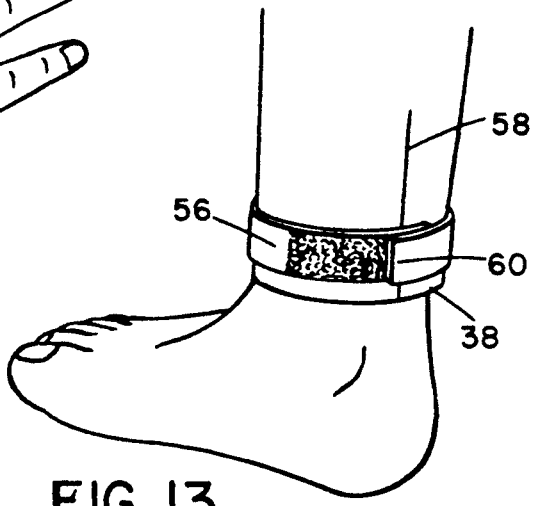
FIG. 13 shows an alternative sealing method for the ankle edge of the bodysuit.

FIGS. 12 and 13 disclose one of several useful alternative wrist, ankle, and neck edge sealing schemes. In FIG. 12, a hook and loop strap is shown embedded in the covering material at wrist edge 38. A slit 58 is provided in the wrist portion of the bodysuit which can be overlapped and secured by strap 56 to provide adjustable closure means. Hook and loop strap 56 can be closed in the manner known in the art as illustrated at closure 60. This discussion applies similarly to the ankle closure shown in FIG. 13.

Figure 14:
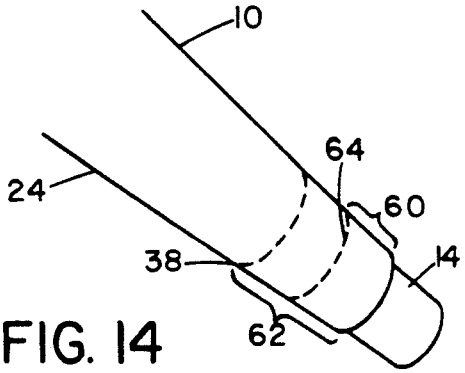
FIG. 14 is a detail showing the extended bodysuit length, finished length, and finished seam length relationships for an illustrated embodiment.

Another alternative method for forming the seals at wrist, ankle and neck is illustrated in FIG. 14. Limb extender 14 is added to each limb of mannequin 10 and bodysuit foundation 24 is extended by adding additional length 60. The seal region 62 is then sprayed with a thin coating and allowed to cure. Additional length 60 is then turned under at fold 64. Seam 38 is then sewn to additional length 60 folded inside to form final wrist, ankle or neck seal.

Figure 15:
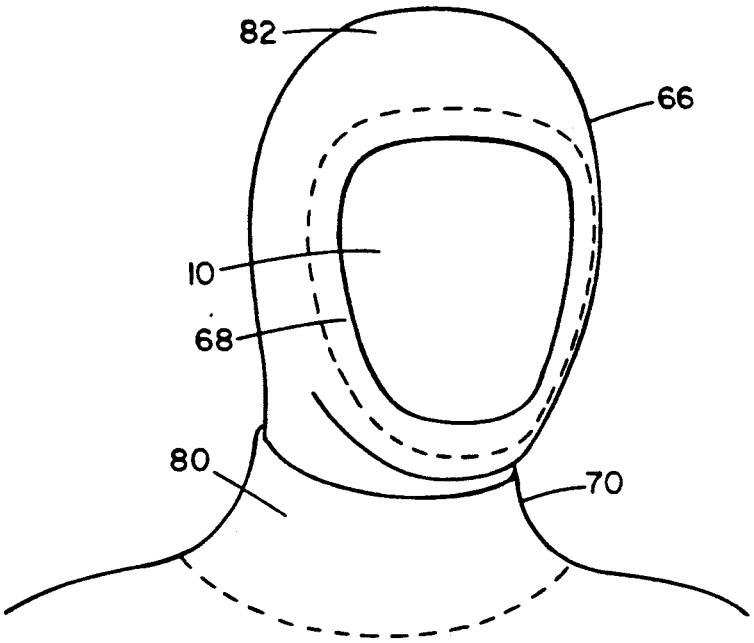
FIG. 15 illustrates an embodiment of means for sealing the neck edge of the bodysuit to hood means.
Figure 16:
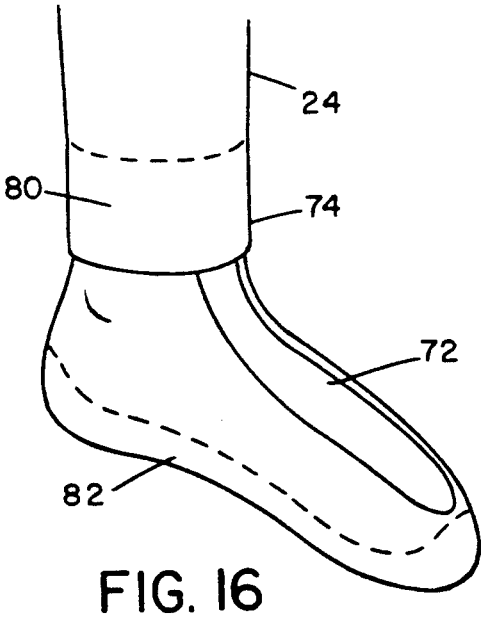
FIG. 16 shows an illustrated method for mating the bodysuit ankle seal to boot means.
Figure 17:
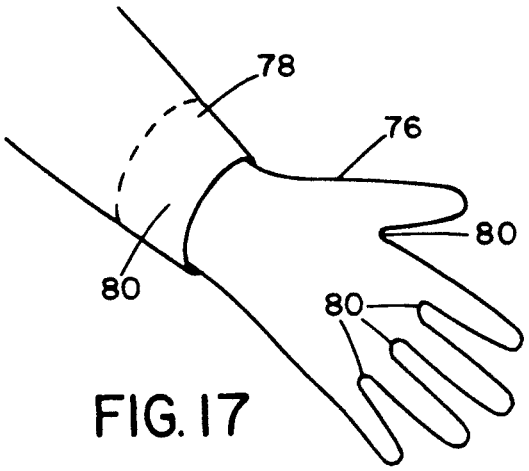
FIG. 17 illustrates a method for mating the bodysuit wrist seal to a glove means.

In biohazardous applications requiring a complete bodysuit, including helmet or hood, boot and glove means. I prefer the sealing scheme illustrated in FIGS. 15–17. In FIG. 15, the hood 66 is shown having sealing regions 68 and 70 coated on both sides with rubber. Faceplate sealing region 68 is adapted for mating with a faceplate or similar device (not shown) and neck sealing region 70 is adapted for mating with the neck sealing region provided on the bodysuit. Neck sealing region 70 is coated with a thinner coating than is normal so that the two overlapping flaps will seal, because of the tension forcing them together, without causing a bump or ripple in the surface of the bodysuit. In FIG. 16, a boot 72 is shown mated to the ankle sealing region 74 of bodysuit 24. Ankle sealing region 74 functions similarly to neck sealing region 70 in FIG. 15. Similarly, FIG. 17 shows the sealing arrangement for a glove 76 at wrist sealing region 78. In FIGS. 15–17, the areas of thinner coating 80 are designated and distinguished from the areas of the thicker coating 82. Because of the 450% stretchability rating of the cured rubber coating, these sealing areas can be readily made to induce uniform tension by inducing stretching in the sealing layers.

In addition to the sealing and mating means discussed above, other means known in the art such as rib and track locking seam (e.g. Zip-lock®), dry suit zipper, and the like are suitable for use with my invention.

Also, as can be appreciated from the above discussion, colors and decorative effects can be combined and intermeshed by using several sprayers during the coating application process. For instance, a portion of bodysuit foundation 26 can be masked during the application of a coating compound having one color and decorative effect and the masked area later coated with another batch of coating compound having a different color and decorative effect while masking the first coated area. Layers of tile or chain mail fabric can be included in the rubber coating for a variety of purposes, such as making the suit impervious to penetration by sharks teeth, providing for a heated fluid layer internal to the coating wall, and other similar applications known in the art.

My bodysuit can be tailored to a variety of different designs such as the full bodysuit illustrated in FIGS. 4–5, a shorty surf suit, a Farmer John bodysuit, and other designs without limitation. My new process is also adaptable to the manufacture of a hybrid dry/wetsuit that is sealed against the ingress of water but not equipped with the pressure compensation provisions normally provided in for a drysuit intended for diving. Of course, my process is adaptable to pressure-compensated diving suits as well.

Other processes adaptable to fabricating a bodysuit using my novel process include a liquid injection molding process that would use a mannequin as a base and an outer form adapted for placement around the mannequin at a separation equal to the desired suit thickness. My coating compound could then be injected as a liquid under pressure into the interstitial space between the mannequin and the outer form and then cured with the assistance of infrared lights and high humidity provided from inside the mannequin. The outer form could then be cooled and the suit removed from the mannequin.

Another process suitable for fabricating a bodysuit using my coating compound would use a suction-type mannequin having an aluminum surface with many perforations to permit the application of a vacuum over the entire mannequin surface area. The fabric bodysuit foundation could then be held against the mannequin by suction, with or without sewn seams, and then coated either by spraying or dipping.

My process can be adapted for electrostatic spraying equipment by adding metal flakes or metalized suspensions to the coating compound as part of the colorizing step.

The most effective method for coating a bodysuit having a precise custom fit involves the use of the wearer as a living base in lieu of a mannequin. The wearer could be covered with a plastic liner to protect the skin from contact with the coating compound during the coating step. The fabric bodysuit foundation could then be placed over the lining layer and coated in accordance with any of the suitable methods discussed above.

Obviously other embodiments and modifications of my invention will occur readily to those of ordinary skill in the art in view of these teachings. Therefore, this invention is to be limited only by the following claims which include all such obvious embodiments and modifications when viewed in conjunction with the above specification and accompanying drawings.

I claim:

1. A process for coating a surface, comprising the steps of:

selecting a first solvent from the group consisting of medium naphtha, 1,1,1-trichloroethane, trichloroethylene, toluene, xylene, methyl ethyl ketone, hexane, methylene chloride, and mixtures of medium naphtha with any of the other solvents in the group;

mixing 100 parts by volume of said first solvent with up to 50 parts by volume of a thermoset resin coloring agent to form a first colorized solvent;

mixing 100 parts by volume of said first colorized solvent with from 0.5 to 2.0 parts by volume of an ultraviolet (UV) stabilizer to form a second colorized solvent;

mixing 100 parts by volume of said second colorized solvent with up to 400 parts by volume of a thixotropic agent to form a thickened colorized solvent;

mixing 100 parts by volume of said thickened colorized solvent with from 10 to 400 parts by volume of silicone rubber adhesive sealant to form a coating compound;

stirring or agitating said coating compound in a container; and applying said coating compound to said surface within eight hours of the preparing step.

2. The process described in claim 1 wherein said container is airtight and said applying step is accomplished by spraying said coating compound onto said surface.

3. The process described in claim 1 wherein said applying step is accomplished by dipping said surface into said coating compound.

4. The process described in claim wherein said applying step is accomplished by brushing said coating compound onto said surface.

5. The process described in claim 1 wherein said applying step further comprises entrapping air bubbles in said coating compound during said applying step.

6. The process described in claim wherein said applying step comprises the steps of:

applying said coating compound to a textile in at least one layer whereby said coating compound adheres to said textile; and curing said layer by ventilating and heating the coated textile.

7. The process described in claim 6 wherein said textile is a stretch fabric and the thickness of said coated textile is less than seven millimeters.

8. The process described in claim 7 wherein said container is airtight and said applying step is accomplished by spraying said coating compound onto said stretch fabric.

9. The process described in claim 7 wherein said applying step is accomplished by brushing said coating compound onto said stretch fabric.

10. The process described in claim 6 wherein said container is airtight and said applying step is accomplished by spraying said coating compound onto said textile.

11. The process described in claim 6 wherein said applying step is accomplished by brushing said coating compound onto said textile.

12. The process described in claim 6 wherein said applying step is accomplished by dipping said textile into said coating compound.

13. A process for fabricating a bodysuit comprising the steps of:

fabricating a bodysuit foundation by sewing a textile covering onto a mannequin;

selecting a first solvent from the group consisting of medium naphtha, 1,1,1-trichloroethane, trichloroethylene, toluene, xylene, methyl ethyl ketone, hexane, methylene chloride, and mixtures of medium naphtha with any other solvent in the group;

mixing 100 parts by volume of said first solvent with up to 50 parts by volume of a thermoset resin coloring agent to form a first colorized solvent;

mixing 100 parts by volume of said first colorized solvent with from 0.5 to 2.0 parts by volume of an ultraviolet (UV) stabilizer to form a second colorized solvent;

mixing 100 parts by volume of said second colorized solvent with up to 400 parts by volume of a thixotropic agent to form a thickened colorized solvent;

mixing 100 parts by volume of said thickened colorized solvent with from 10 to 400 parts by volume of silicone rubber adhesive sealant to form a coating compound;

applying said coating compound in at least one layer to said bodysuit foundation to form a coated bodysuit foundation;

curing said layer; and removing said coated bodysuit foundation from said mannequin.

14. The process for fabricating a bodysuit described in claim 13 wherein said fabricating step comprises the additional step of extending said bodysuit foundation at the wrist, ankle, and neck openings to form excess length at each said opening that may be turned under after said curing step, thereby sealing each said opening while worn.

15. The process for fabricating a bodysuit described in claim 14 wherein said applying step comprises the additional steps of:

controlling said applying step to thin said layer at the inside bodysuit joints to enhance flexibility; and adding at least one coating layer to thicken said bodysuit at the outside joints to enhance resistance to heat transfer and abrasion.

16. The process for fabricating a bodysuit described in claim 13 wherein said removing step comprises the additional steps of:

turning said body suit inside-out;

turning over a portion of the bodysuit textile at each wrist, ankle, and neck opening; and repeating said applying, curing and removing steps for each said portion at all said openings.

17. The process for fabricating a bodysuit described in claim 13 wherein said applying step comprises the additional steps of:

controlling said applying step to thin said layer at the inside bodysuit joints to enhance flexibility; and adding at least one coating layer to thicken said bodysuit at the outside joints to enhance resistance to heat transfer and abrasion.

18. The process described in claim 1 wherein the last said mixing step comprises the additional step of mixing up to 50 parts by volume of decorative particles or flakes into 100 parts by volume of said coating compound to form a coating compound having a decorative particulate suspension.

19. A process for coating a surface, comprising the steps of:

forming a first solvent mixture;

mixing an amount greater than 0 parts by volume and up to 100 parts by volume of the first solvent mixture with from 10 to 400 parts by volume of silicone rubber adhesive sealant to form a coating compound;

the first solvent mixture including at least one solvent selected from the group consisting of medium naphtha, 1,1,1-trichloroethane, trichloroethylene, toluene, xylene, methyl ethyl ketone, hexane, and methylene chloride;

stirring or agitating said coating compound in a container; and applying said coating compound to said surface within eight hours of forming said coating compound.

20. The process as claimed in claim 19, wherein the step of forming the first solvent mixture comprises mixing 100 parts by volume of said at least one solvent with up to 50 parts by volume of a thermoset resin colorizing agent to form a colorized solvent.

21. The process as claimed in claim 20, wherein the step of forming the first solvent mixture comprises the additional step of mixing 100 parts by volume of said colorized solvent with from 0.5 to 2.0 parts by volume of an ultraviolet stabilizer to form a second colorized solvent.

22. The process as claimed in claim 19, wherein the step of forming the first solvent mixture comprises mixing 100 parts by volume of said at least one solvent with up to 400 parts by volume of a thixotropic agent to form a thickened solvent.

* * * * *